US006725473B2

(12) United States Patent
Grossman et al.

(10) Patent No.: US 6,725,473 B2
(45) Date of Patent: Apr. 27, 2004

(54) MULTI-ANGLE HOOK AND L-SHAPED HINGE

(75) Inventors: Joel Grossman, Selanger (MY); Howard Porter, Kuala Lumpur (MY)

(73) Assignee: Grossman Product Services SDN. BHD., Kuala Lumpur (MY)

( * ) Notice: Subject to any disclaimer, the term of this patent is extended or adjusted under 35 U.S.C. 154(b) by 0 days.

(21) Appl. No.: 09/917,857

(22) Filed: Jul. 31, 2001

(65) Prior Publication Data

US 2003/0024044 A1 Feb. 6, 2003

(51) Int. Cl.[7] ..... A47C 17/04
(52) U.S. Cl. ..... 5/37.1; 5/12.1; 5/47
(58) Field of Search ..... 5/37.1, 12.1, 47, 5/41, 42, 39, 48; 297/354.13; 403/154

(56) References Cited

U.S. PATENT DOCUMENTS 4,113,397 A * 9/1978 Snyder ..... 403/154
4,875,244 A * 10/1989 Tremblay ..... 5/37.1
5,519,902 A * 5/1996 Meade ..... 297/354.13
6,108,833 A * 8/2000 Grossman et al. ..... 5/12.1

* cited by examiner

*Primary Examiner*—Teri Pham Luu
*Assistant Examiner*—Fredrick Conley
(74) *Attorney, Agent, or Firm*—Harness, Dickey & Pierce, P.L.C.

(57) ABSTRACT

A multi-angle hook fastened to an extension member, that is used to stop the extension from completely pulling out of the frame it sits in. When fully extended, the multi-angle hook allows at least three different holding positions, seen as three different angles that the extension sits at while using the multi-angle hook as its fixed point of pivot. The multi-angle hook is a metal, plastic, or wood plate bent along several parallel lines, across its width, at varying angles. An L-shaped hinge which is used to secure a side rail-less frame member to another frame member, to avoid undue stress on the side rail-less frame member. The L-shaped hinge is a metal, plastic, or wood plate which substantially conforms to a portion of a side rail-less frame member.

28 Claims, 15 Drawing Sheets

Lounger Position

Steamer Position

Bed Position

MULTI-ANGLE HOOK AND L-SHAPED HINGE

CROSS-REFERENCE TO RELATED APPLICATIONS

This application claims the benefit under 35 U.S.C. §120 of U.S. Non-Provisional Application of Joel Grossman entitled "Multi-Angle Hook", Ser. No. 09/761,108, filed on Jan. 17, 2001, the entire contents of which are hereby incorporated by reference.

BACKGROUND

1. Field of the Invention

The present invention is generally directed to a multi-angle hook and an L-shaped hinge and more particularly, to a multi-angle hook and an L-shaped hinge for use with a furniture extension.

2. Description of the Related Art

Futon frames come in one of at least two different configurations, bi-fold, and tri-fold. In a bi-fold configuration illustrated in FIG. 1, a convertible futon sofa-bed frame allows the futon mattress to fold once along its length. Typically, bi-fold configurations are utilized for larger width furniture, such as sofas, so that one or more persons may lie on the futon sofa-bed frame, with the orientation illustrated in FIG. 2.

The tri-fold configuration, illustrated in FIG. 3, is more commonly utilized for narrower futon frames (for example a 28" wide chair or 54" wide loveseat). In a tri-fold, the futon mattress is folded twice along its usually shorter width. A futon mattress may hang over the back of the frame or be folded under the seat itself, or lay flat as a chaise lounge style seat. A person lies on the tri-fold in the orientation illustrated in FIG. 4.

An extension 10 may be added to the seat platform 12 of a futon frame to form a leg-rest (as an ottoman) as well as giving extra length to smaller size futon frames to allow the user to form the full length bed illustrated in FIG. 4.

The extension 10 may be a framed platform including outer frame members and inside slat components. The slats of the extension 10 commonly "nest" into the slats of the seat platform 12; in other words, the extension slats slide in between the slats of the seat platform 12, sliding in and out in relation to them.

The extension 10 may be fastened to the seat in various ways but most commonly there is a bar of wood or metal on the underside of (and at the rear of) the extension slats which holds the extension slats together as fixed group. This bar also serves to stop the extension 10 from being pulled completely out of the seat platform 12. The bar is below the slats and stops firmly against the frame of the seat platform 12 keeping the extension 10 from pulling out completely. This bar is permanently fixed to the extension 10 and makes removal of the extension 10 from the rest of the frame impossible.

SUMMARY OF THE INVENTION

The present invention changes the nature of the attachment of the extension to the seat platform by allowing easy and complete removal of the extension from the seat platform.

The present invention utilizes a multi-angle hook that allows the extension platform to be freely lifted off the seat platform and alternately lowered and set into place.

This flexibility is advantageous in the following ways:

1) conversion of the futon frame into its various positions (bed, recliner, and upright-sofa) is easier to do as the frame is easier to manipulate with the extension removed;

2) defective parts are easily replaced; and/or 3) parts management in manufacturing is simpler thereby saving production cost.

Additionally, the multi-angle hook is stepped at its holding points to allow for at least two positions most extensions require:

1) Horizontal: flat for straight-legged position, such as a bed position; and 2) angled to the floor: a "steamer" position.

Further, the present invention allows the seat platform to not include side rails. The present invention utilizes an L-shaped hinge, attachable to the seat platform, for securing the side rail-less seat platform to a back platform.

DETAILED DESCRIPTION OF THE PREFERRED EMBODIMENTS

Figure 1:
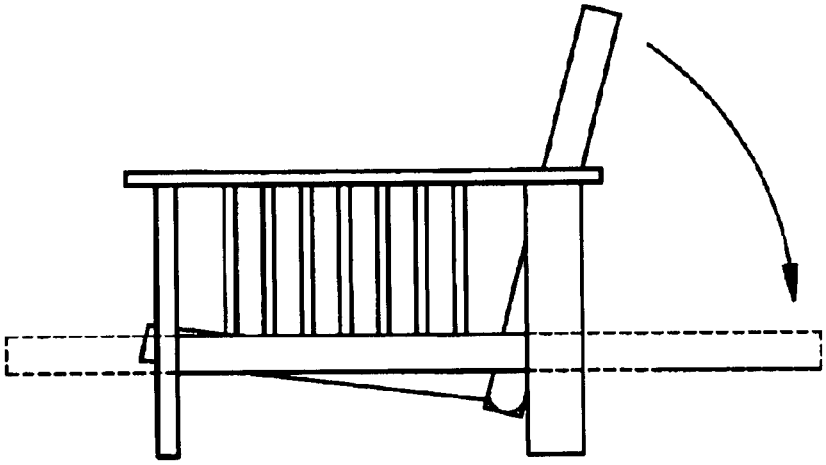
FIG. 1 illustrates a conventional bi-fold configuration.
Figure 3:
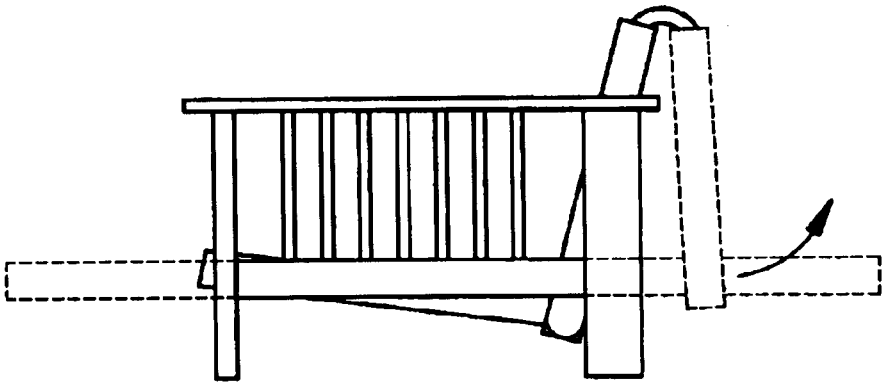
FIG. 3 illustrates a conventional tri-fold configuration.
Figure 2:
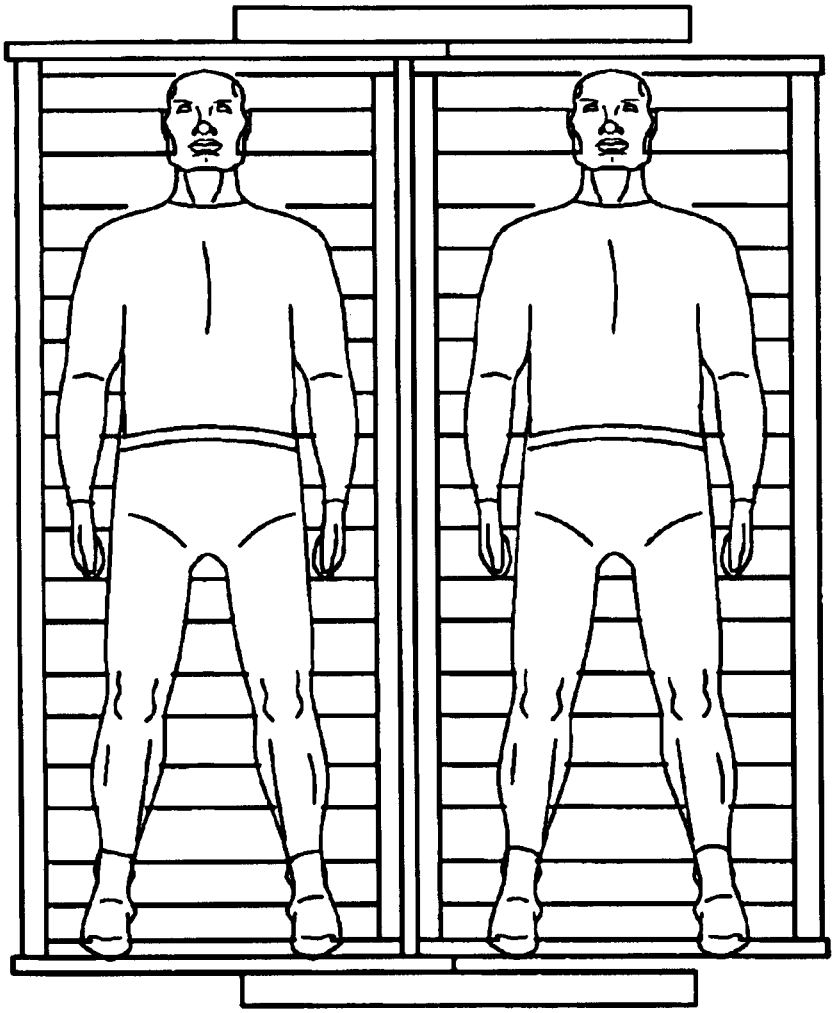
FIG. 2 illustrates the typical orientation of person(s) lying on a bi-fold futon bed-frame.
Figure 4:
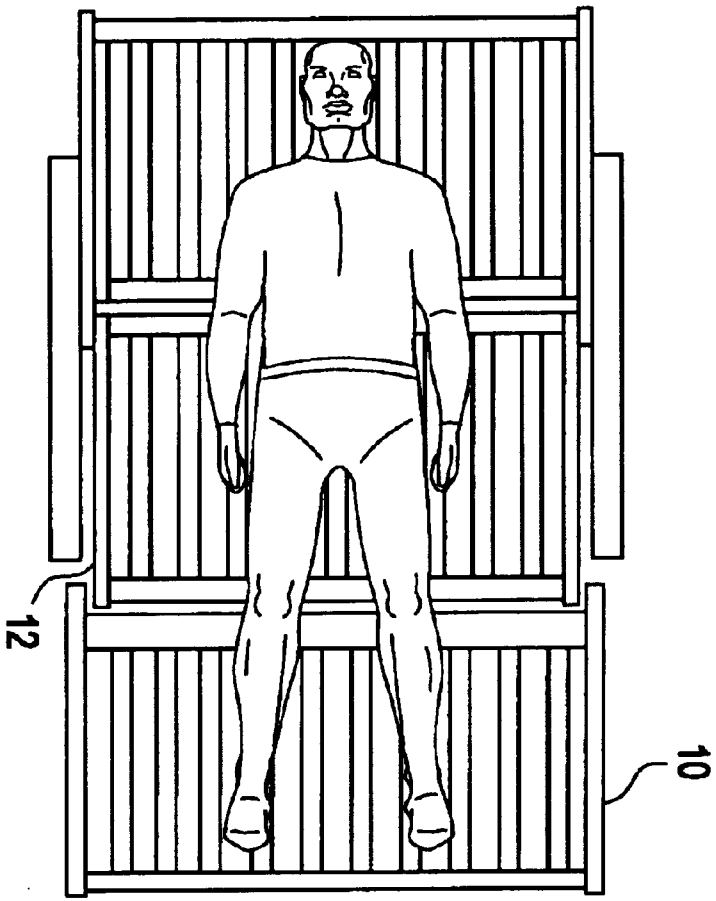
FIG. 4 illustrates the typical orientation of a person lying on a tri-fold futon bed-frame.
Figure 5A:
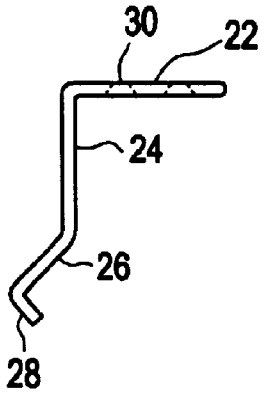
FIGS. 5*a*–5*d* illustrate the multi-angle hook in one exemplary embodiment of the present invention.
Figure 5B:
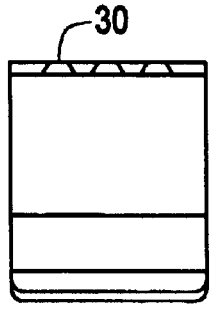
Figure 5D:
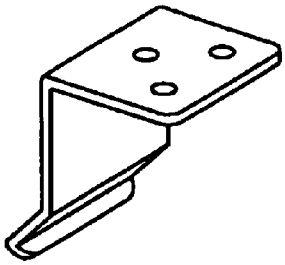
Figure 5C:
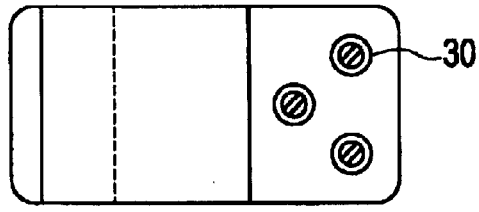

FIGS. 5*a*–5*d* illustrate the multi-angle hook 20 in one exemplary embodiment of the present invention. FIG. 5*a* illustrates a side view, FIG. 5*b* a front view, FIG. 5*c* a foldout view, and FIG. 5*d* an additional view. As illustrated in FIG. 5*a*, the multi-angle hook 20 includes a member 22 and a member 24, which, as shown, are at a right angle or substantially a right angle to each other, although this is not essential. In fact, the angle between members 22 and 24 can be any angle as long as the angle is capable of a portion of the seat platform 12, which will be discussed in more detail below with respect to FIGS. 6*a*–6*d*. The multi-angle hook 20 also includes a member 26 and a member 28. In a preferred embodiment, the multi-angle hook 20 is formed as a single piece, preferably of metal, but also possibly of any type of rigid, sturdy, plastic, wood or any other suitable material. As illustrated in FIGS. 5*a* and 5*d*, the angle between members 22 and 24 is obtuse, in particular, approximately 135° and the angle between members 26 and 28 is a right angle or substantially a right angle to each other, although these values are also not essential. In fact, similar to the angle between members 22 and 24, the angles between members 24 and 26 and members 26 and 28 can be any angle as long as the angles are capable of catching a portion of the seat platform 12, which will be discussed in more detail below with respect to FIGS. 6*a*–6*d*.

As illustrated in FIGS. 5*a*–5*d*, the multi-angle hook 20 includes at least one hole 30 for securing the multi-angle hook to the extension 10. In a preferred embodiment, the at least one hole 30 is counter-sunk. In another preferred embodiment, the number of holes 30 is three, although any number of holes may be used. Further, the manner in which the multi-angle hook 20 is secured to the extension 10, such as, screws, bolts, nails, rivets, pins, staples, snaps, (or any other suitable fastener), glue (which might obviate the need for holes altogether), etc., is not significant, as long as the multi-angle hook 20 and the extension 10 are secured together.

Figure 6A:
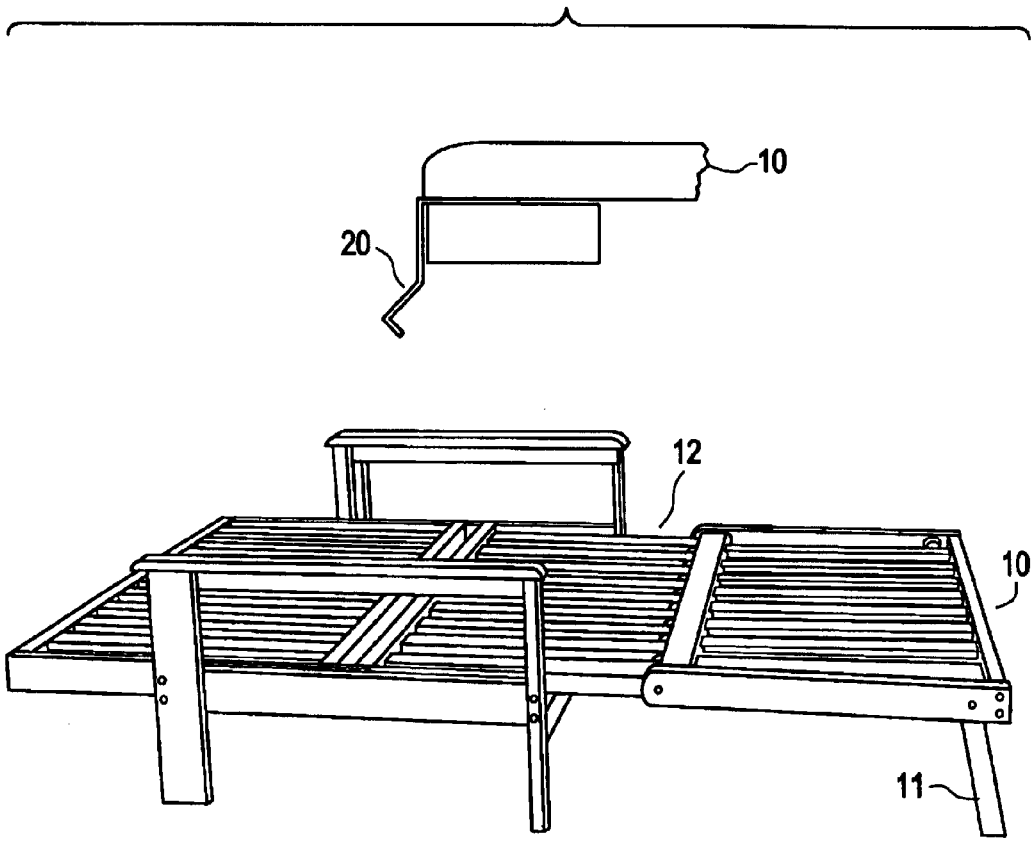
FIGS. 6*a*–6*d* illustrate the relationship between the extension, the seat platform, and the multi-angle hook of the present invention in several exemplary positions.

FIGS. 6*a*–6*d* illustrate the relationship between the extension 10, the seat platform 12, and the multi-angle hook 20 in several positions. FIG. 6*a* illustrates the bed position, where the extension 10 and the seat platform 12 are both substantially parallel to the floor. As illustrated in FIG. 6*a*, the multi-angle hook 20 is secured to the extension 10 and the multi-angle hook 20 is arranged such that it catches the seat platform 12. As illustrated, member 22 of the multi-angle hook 20 contacts and is substantially parallel to a top side of the seat platform 12 and member 24 of the multi-angle hook 20 contacts and is substantially parallel to a front side of the seat platform 12. In this manner, the extension 10 is supported by the seat platform 12 at one end and via legs 11 at the other end. Further, the multi-angle hook 20 enables the extension to temporarily engage the seat platform 12, when in the bed position.

Figure 6B:
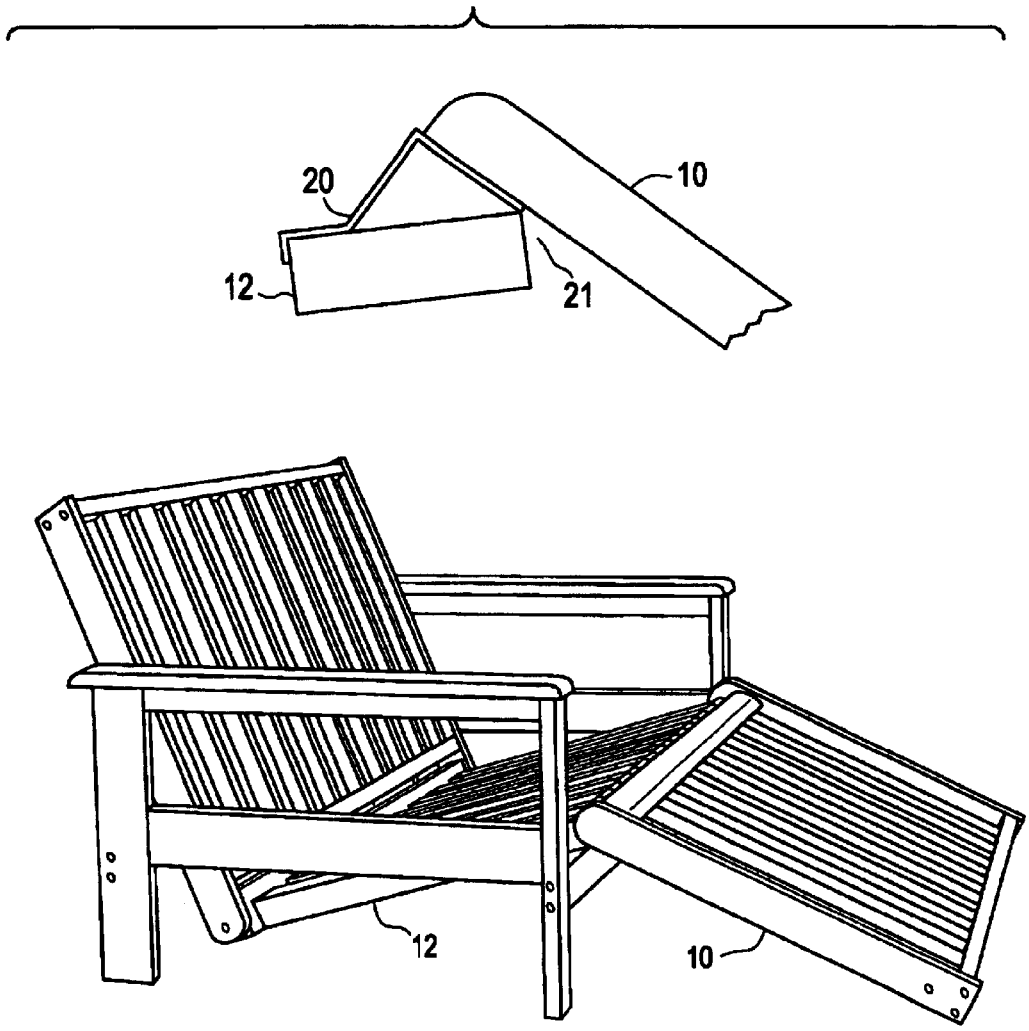
Figure 6C:
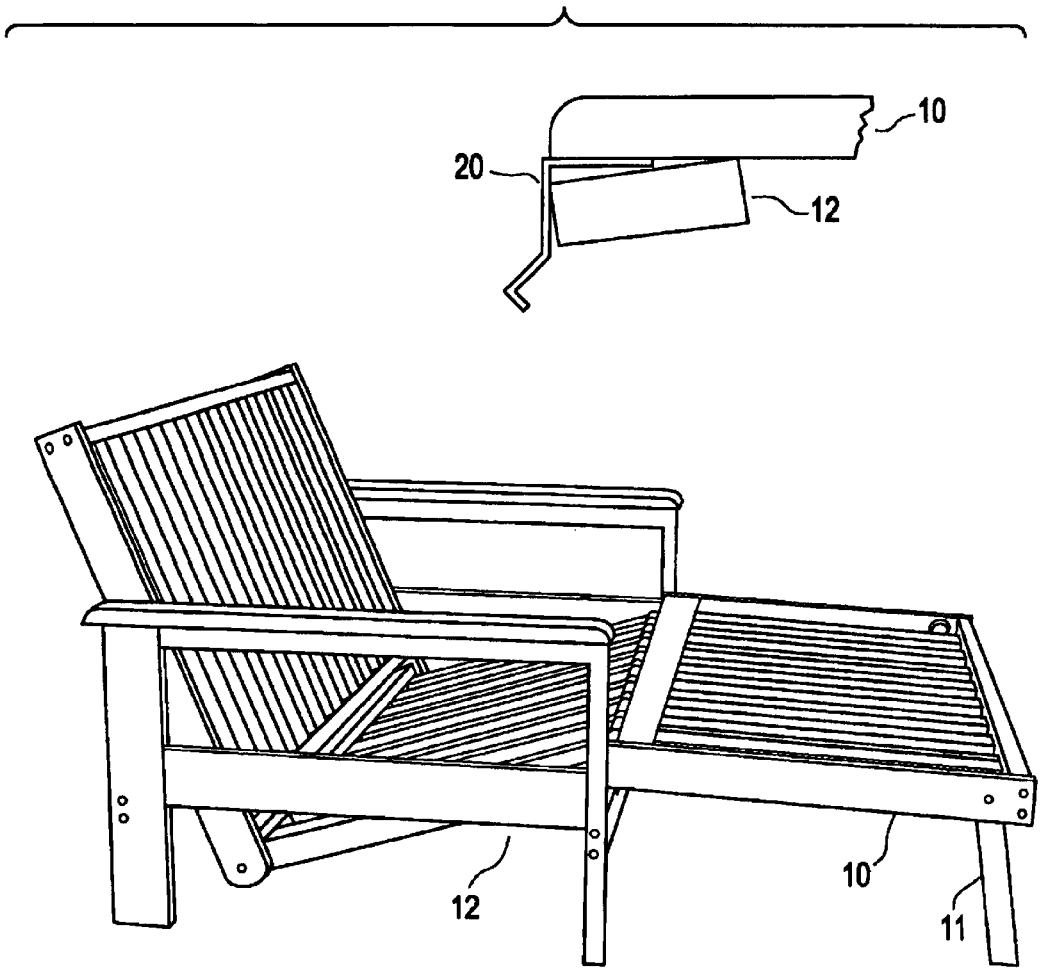

FIG. 6*b* illustrates the steamer position, where the extension 10 and the seat platform 12 are both substantially tilted with respect to the floor. As illustrated in FIG. 6*b*, the multi-angle hook 20 is secured to the extension 10 and the multi-angle hook 20 is arranged such that it again catches the seat platform 12. As illustrated, member 26 of the multi-angle hook 20 contacts and is substantially parallel to a top side of the seat platform 12 and member 28 of the multi-angle hook 20 contacts and is substantially parallel to a front side of the seat platform 12. In this manner, the extension 10 is supported by the seat platform 12 at one end and via the floor on the other end. Further, the multi-angle hook 20 enables the extension to temporarily engage the seat platform 12, when in the steamer position. It may also be advantageous for member 22 to have a notch or indent 21, at one end to further secure the seat platform 12. It is further noted that member 28 is optional FIG. 6*c* illustrates the lounger position, which is somewhat of a hybrid between the bed position and the steamer position in that the extension 10 may be parallel or substantially parallel to the floor as in the bed position (although the seat platform 12 is not) or the extension 10 may be tilted with respect to the floor, but less tilted than the seat platform 12 in the steamer position. As illustrated in FIG. 6*c*, the multi-angle hook 20 is secured to the extension 10 and the multi-angle hook 20 is arranged such that it again catches the seat platform 12. As illustrated, member 24 of the multi-angle hook 20 contacts the side of the seat platform 12 and member 22 and/or the extension 10 itself contact the top side of the seat platform 12. In this manner, the extension 10 is supported by the seat platform 12 at one end and via the legs 11 on the other end. Further, the multi-angle hook 20 enables the extension to temporarily engage the seat platform 12, when in the lounger position. It may also be advantageous for member 24 and/or member 22 (or the extension 10 itself to have a notch or indent 21, to further secure the seat platform 12.

Figure 6D:
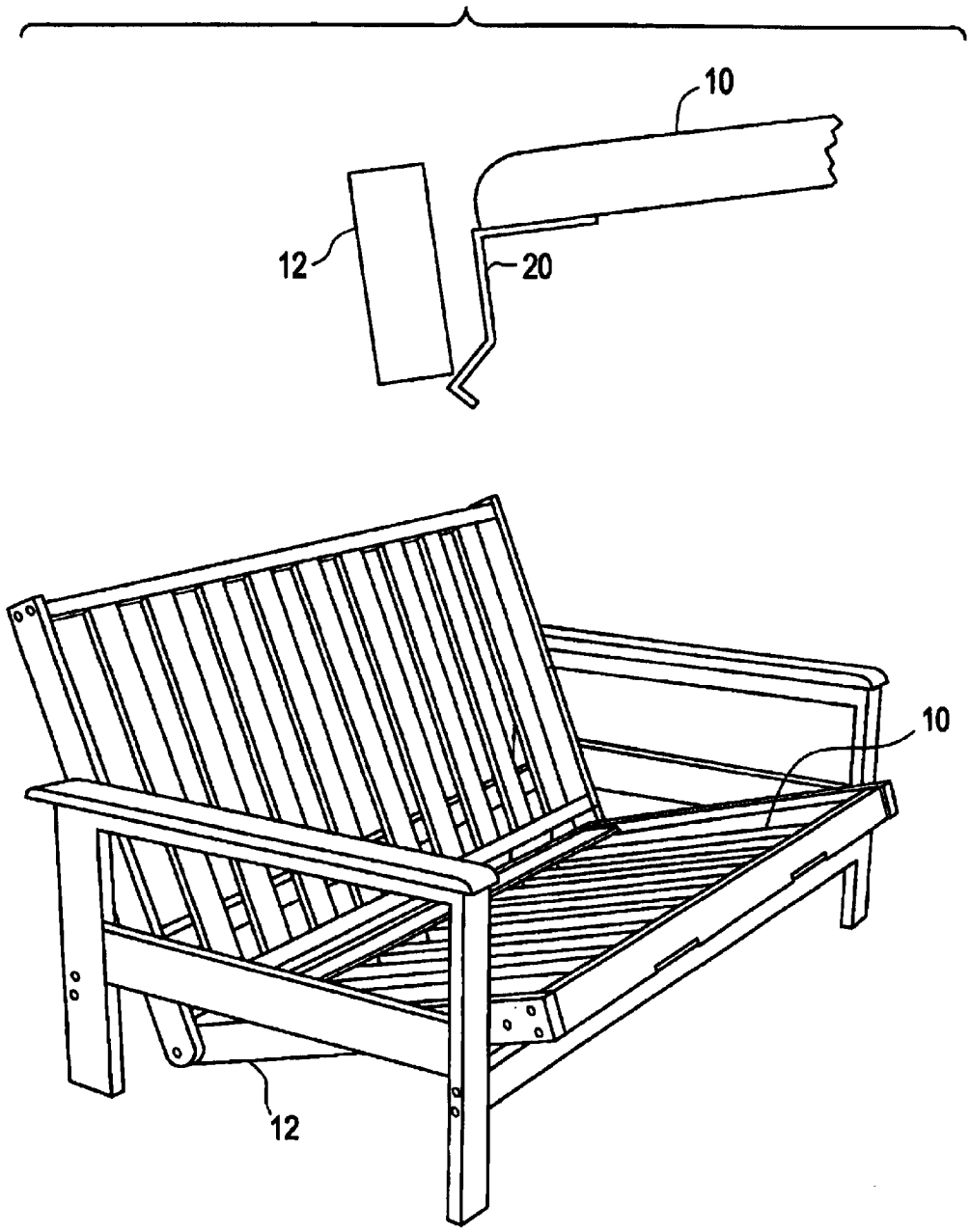

FIG. 6*d* illustrates the closed or unextended position, where the slats of the extension 10 are nested within the slats of the seat platform 12. The extension slats slide in between the slats of the seat platform 12, sliding in and out in relation to them. As illustrated in FIG. 6*d*, the extension 10 and the seat platform 12 are both substantially tilted with respect to the floor. As illustrated in FIG. 6*d*, the multi-angle hook 20 is arranged in front of a rear rail of the seat platform 12. As illustrated in FIG. 6*d*, there is little or no interaction between the multi-angle hook and the seat platform 12 in the closed or unextended position.

Figures 7A, 7B, 7C:
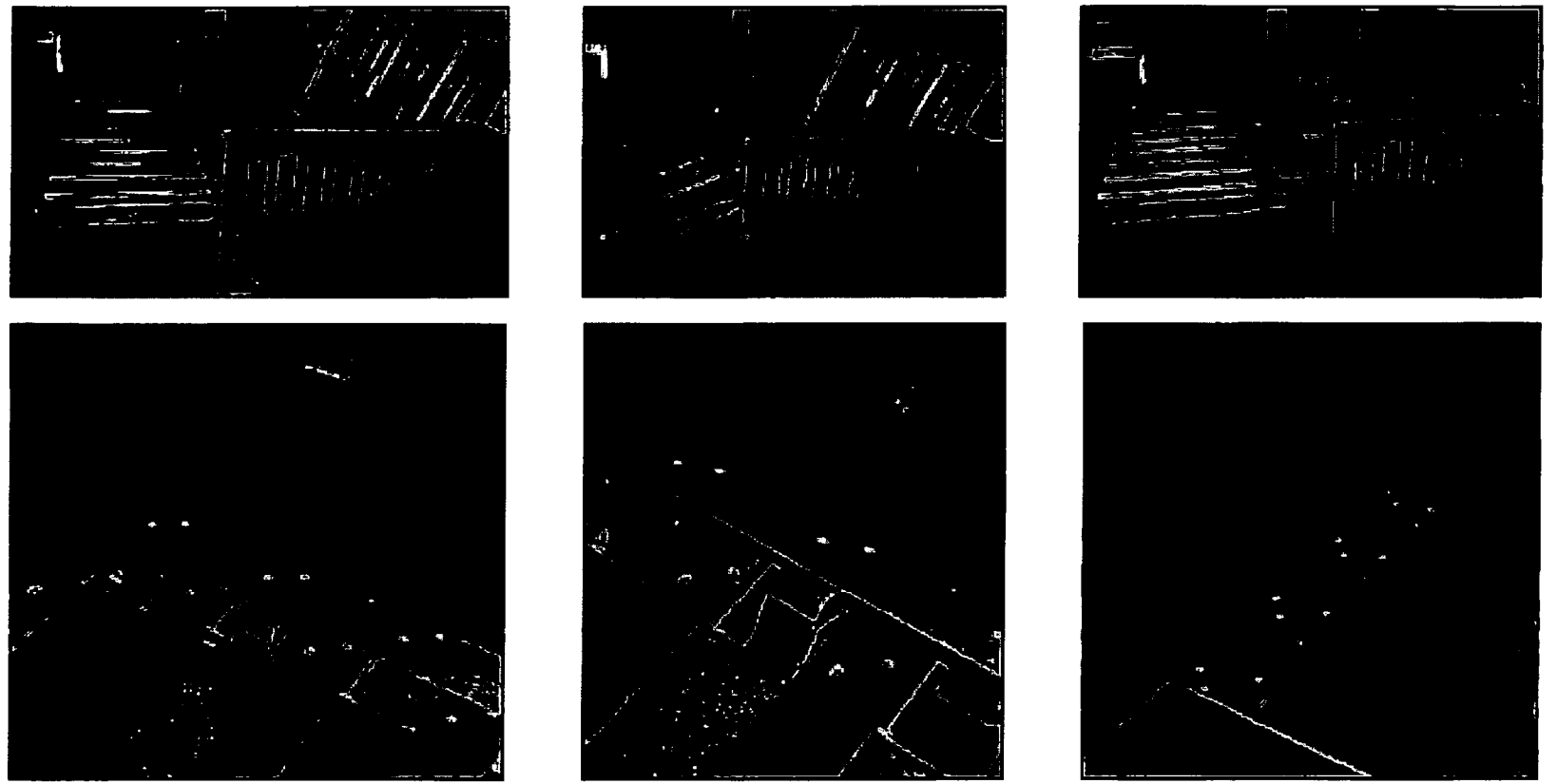
FIGS. 7*a*–7*c* illustrate the lounger position, the steamer position, and the bed position, respectively, from additional angles.

FIGS. 7*a*–7*c* illustrate the lounger position, the steamer position, and the bed position, respectively, from additional angles.

In order to facilitate the attachment of the legs 11 of the extension 10 to the extension 10 itself, it may be advantageous to eliminate side rails from the seat platform 12. As illustrated in FIG. 6*a*, the extension 10 includes side rails (as does the back platform 13), but the seat platform 12 does not. This arrangement allows easy and secure attachment of the legs 11 to the extension 10.

Further, hinging of the seat platform 12 and the back platform 13 may be better achieved by not utilizing the conventional futon frame pivot connection. The conventional connection for futon frames is a clevis pin passing through a hole on the back platform side rail 13' and again through a hole in the seat platform side rail thereby coupling the two platforms together. Without a seat platform side rail to connect to, the clevis pin passing through the back platform side rail 13' has only the end of the seat long rail to be inserted into. The stress on a wood rail, created in this manner, may be excessive and could subject the seat long rail to cracking along the wood grain.

Figure 8:
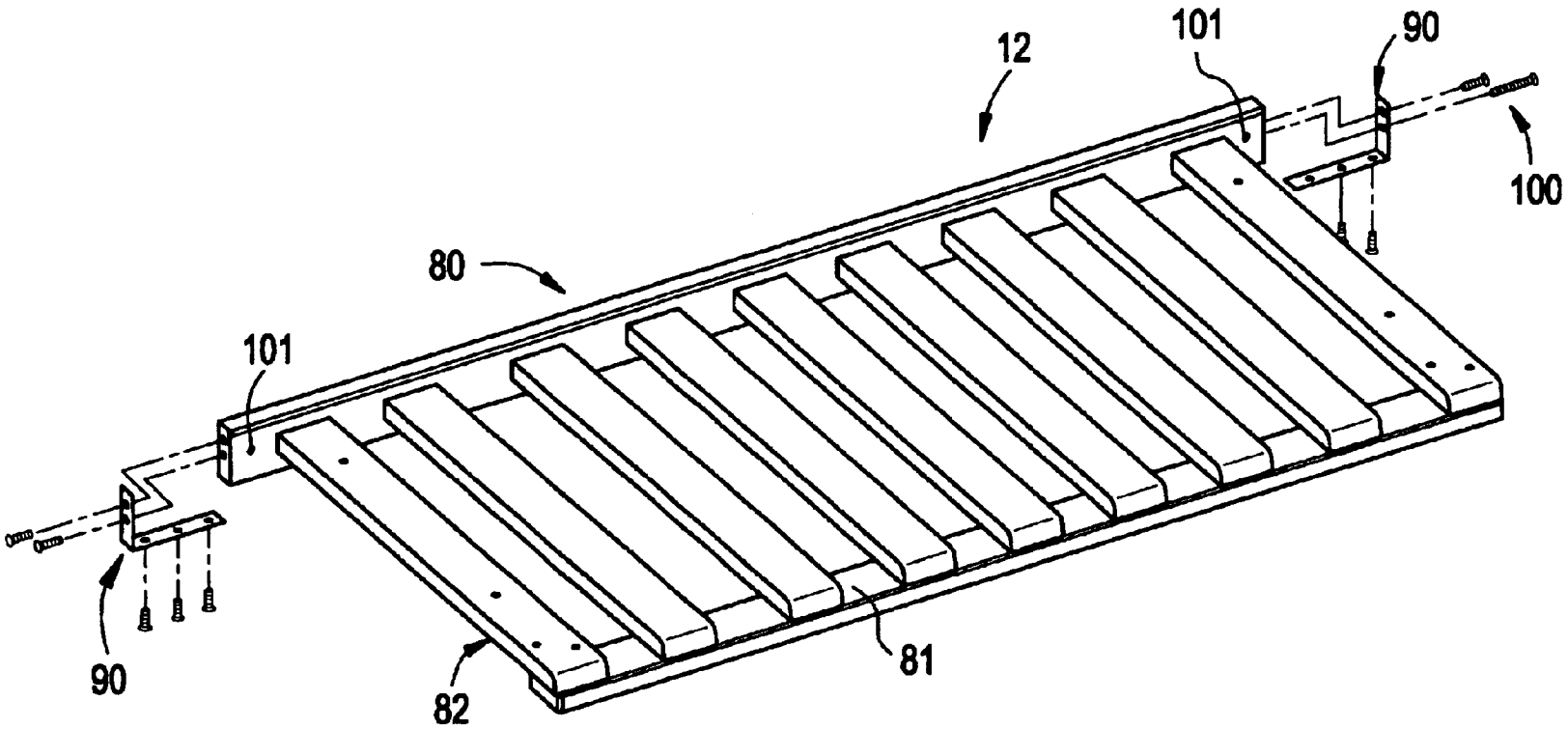
FIG. 8 illustrates a seat platform and an L-shaped hinge in one exemplary embodiment of the present invention.
Figure 9A:
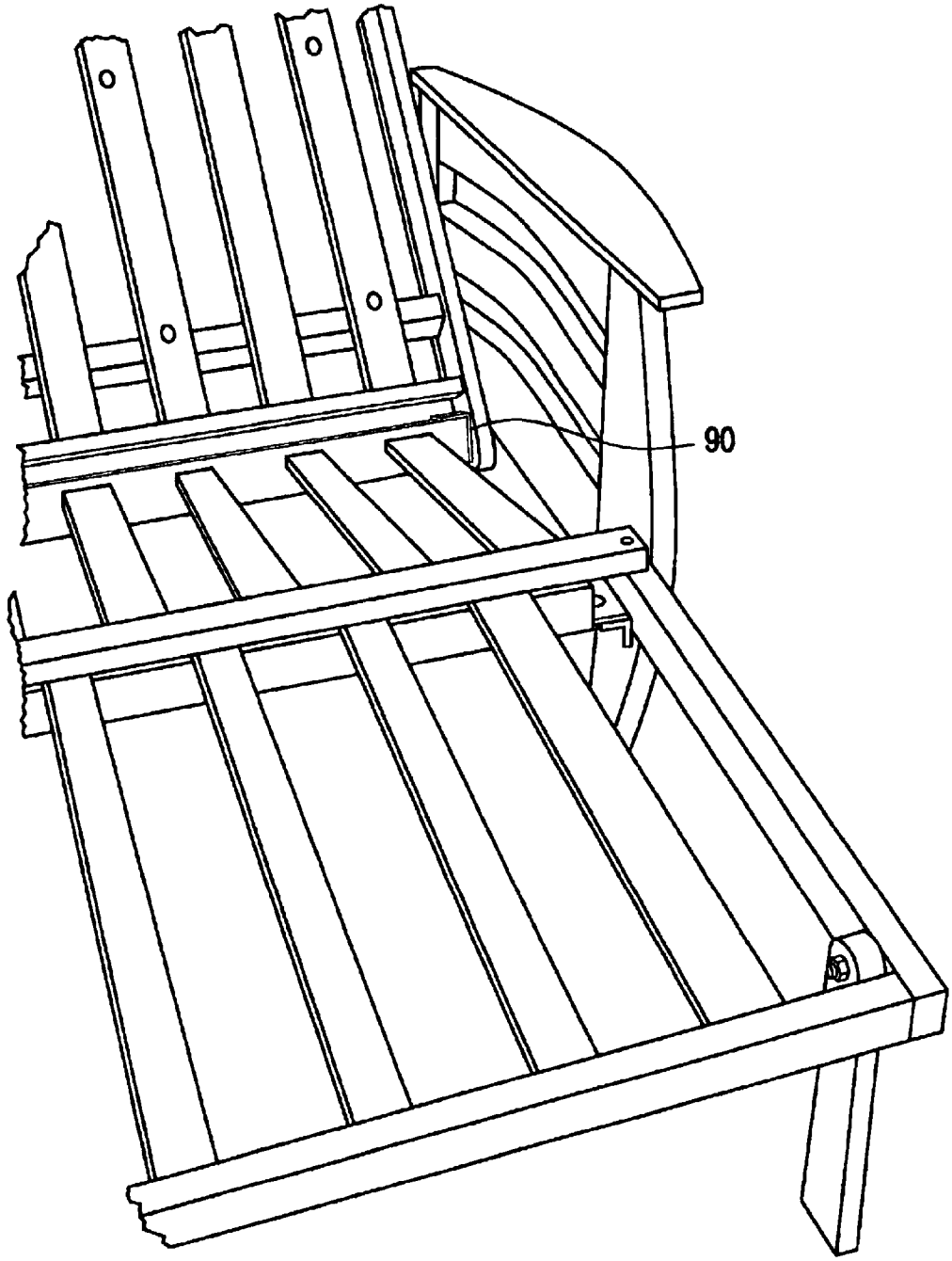
FIGS. 9*a*–9*d* illustrate the L-shaped hinge in an assembled futon frame, from various angles, in one exemplary embodiment of the present invention.
Figure 9B:
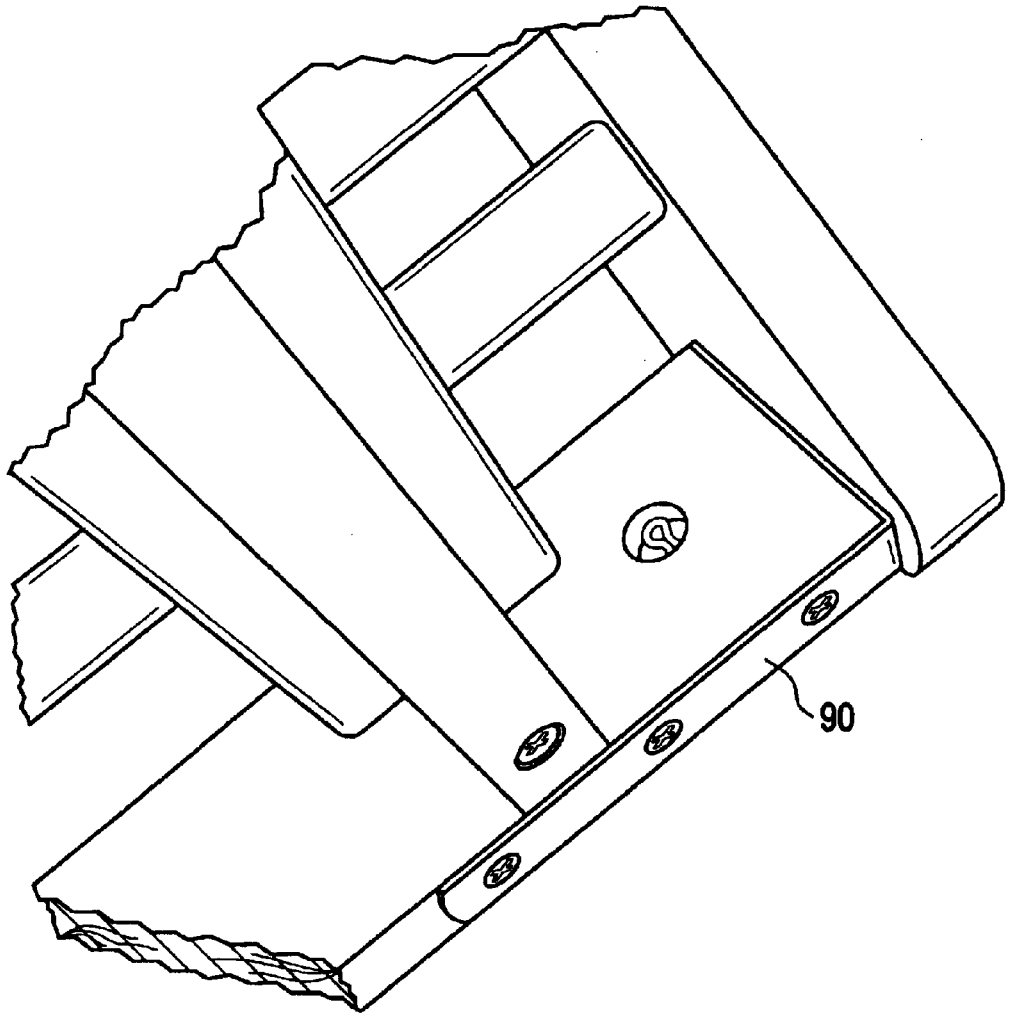
Figure 9C:
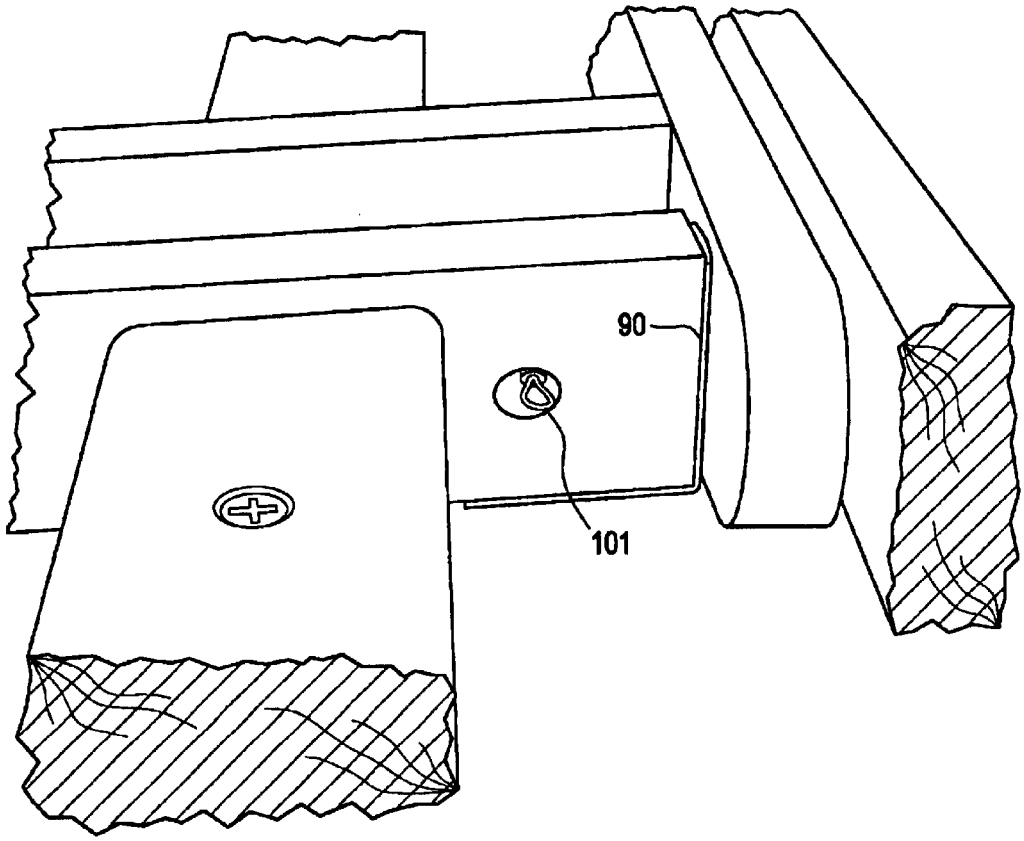
Figure 9D:
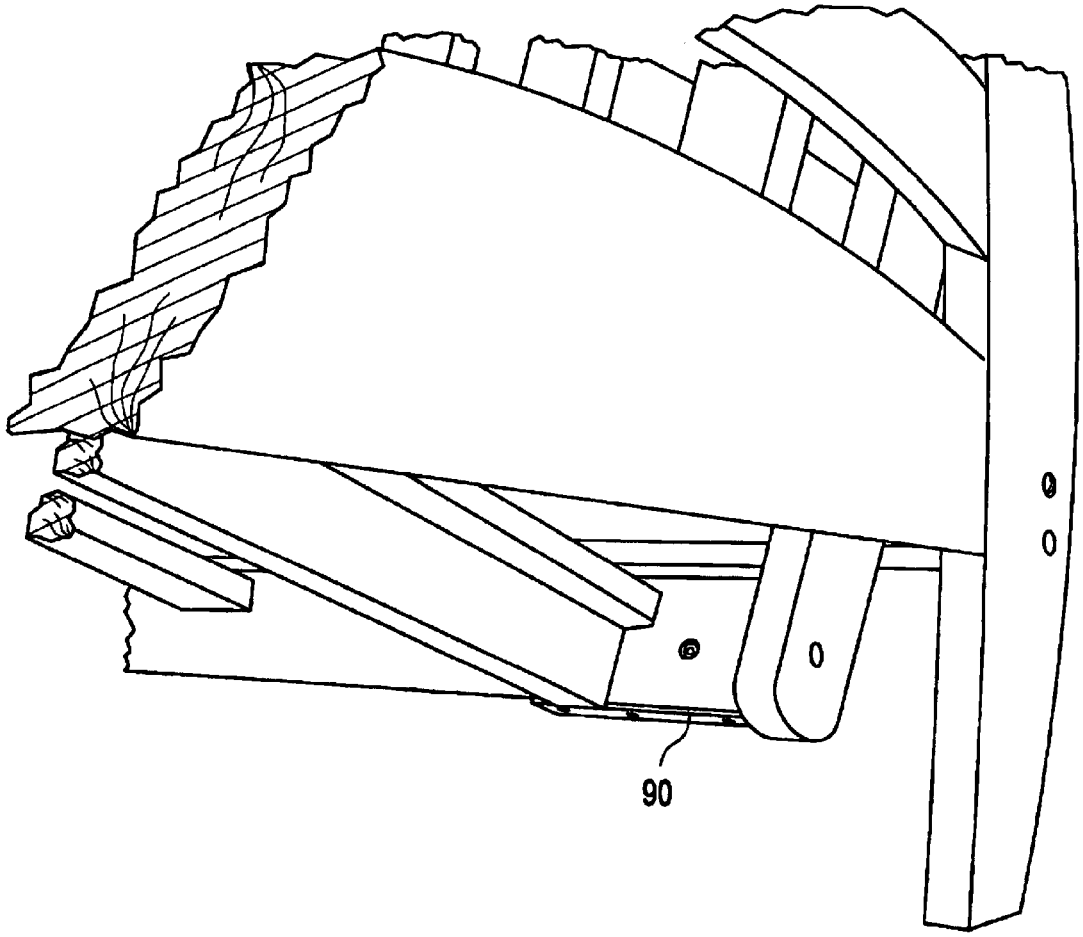

FIG. 8 illustrates a solution to this problem, namely an L-shaped hinge attachable to the seat platform 12 for the purpose of coupling the seat platform 12 and the back platform 13 together, allowing the seat platform 12 and the back platform 13 to pivot freely and securely in relation to each other. As illustrated in FIG. 8, the seat platform 12 includes a rear long rail 80, a front long rail 81, slats 82, and no side rails. The L-shaped hinge 90 gives the required support to the end of the rear long rail 80, when secured to the back platform side rail 13' of FIG. 6*a*.

The seat platform 12 is coupled to the back platform 13 by inserting a clevis pin 100 through a hole in the back platform side rail 13' and into the seat rear long rail 80, first passing through the L-shaped hinge 90, which is securely attached to the seat rear long rail 80.

With the clevis pin 100 fully inserted as described, the clevis pin 100 is then locked into place with a conventional locking pin. The locking pin is fit through one of one or more holes (102 shown in FIGS. 10*e*–10*f*) in and through (substantially perpendicular to) the far tip (away from the head) of the clevis pin 100.

To allow access by the locking pin to the hole at the far tip of the clevis pin 100 while the clevis pin 100 is fully inserted into the seat rear long rail 80, an access hole 101 is provided in and through (substantially perpendicular to) the surface of the seat rear long rail 80. The relationship between the seat rear long rail 80, the L-shaped hinge 90, and the access hole 101 is further illustrated in FIGS. 9*a*–9*d*.

Figure 10F:
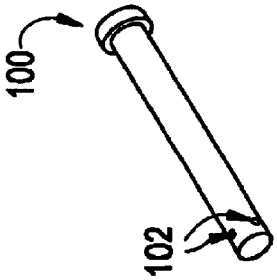
FIGS. 10*a*–10*d* illustrate the L-shaped hinge from various perspectives and FIGS. 10*e*–10*f* illustrates a securing device for securing the L-shaped hinge to a frame component in one exemplary embodiment of the present invention.
Figure 10E:
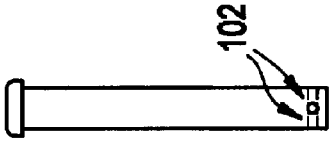
Figure 10D:
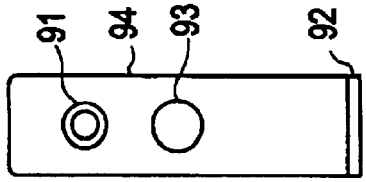
Figure 10A:
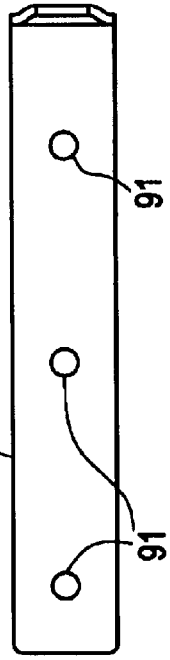
Figure 10B:
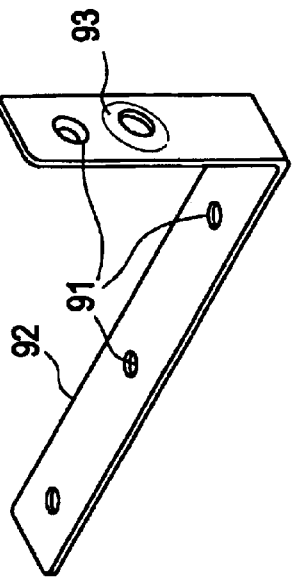
Figure 10C:
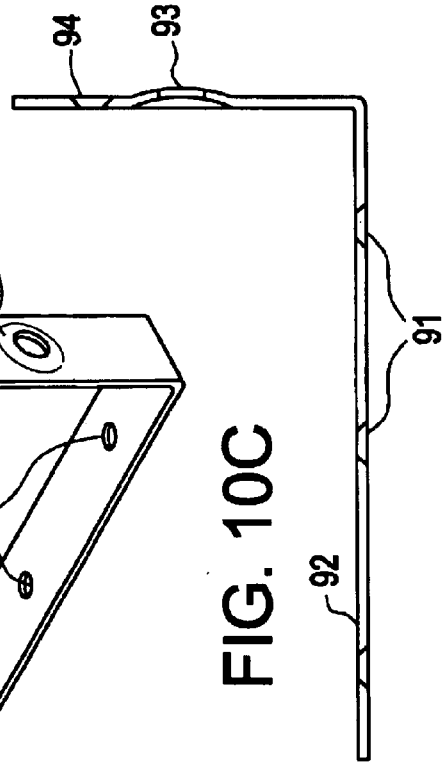

FIGS. 10*a*–10*f* illustrate an exemplary L-shaped hinge 90 and associated clevis pin 100, in more detail. FIGS. 10*a*, 10*b*, 10*c*, and 10*d* illustrate top, isometric, front, and outside views, respectively, of the L-shaped hinge 90. The L-shaped hinge 90 includes at least two flanges 92, 94, which form around the end of the seat rear long rail 80. The flanges 92, 94 include one more holes 91 to secure the L-shaped hinge 90 to the seat rear long rail 80. The holes 91 may be countersunk. The flange 94 also includes a hole 93 for the clevis pin 100. As most clearly illustrated in FIG. 10*b*, the hole 93 is not countersunk, and in fact, may extend outwardly. FIGS. 10*e*–10*f* illustrate top and isometric views, respectively of the holes 102 of the clevis pin 100, in more detail.

As illustrated in FIGS. 10*e*–10*f*, to allow easy insertion of the locking pin into the clevis pin 100, the clevis pin 100 includes holes 102, in substantially the same transverse plane, but approximately 90° apart. The holes 102 allows easy access for the locking pin to a hole in the clevis pin 100, regardless of the clevis pin's random rotation in the seat rear long rail 80.

Although each of FIGS. 6*a*–6*d* and 7*a*–7*c* illustrate two multi-angle hooks, any number of hooks 20 may be utilized. Further, although the multi-angle hook 20 of FIGS. 6*a*–6*d* and 7*a*–7*c* contacts top and front sides of the front rail of the seat platform 12, the multi-angle hook 20 may contact any surface of the seat platform 12 or the extension 10 to accomplish the desired goal. Still further, although the multi-angle hook 20 of FIGS. 6*a*–6*d* and 7*a*–7*c* is shown as being attached to the extension 10, the multi-angle hook could also be attached to the seat platform 12. Still further, the multi-angle hook 20 may be configured so that in the lounger position, the extension 10 is inclined with respect to the floor (FIG. 6*c*) or parallel to the floor (FIG. 7*a*).

It is obvious from FIGS. 6*a* and 6*c* that member 28 is unnecessary in both the bed and lounger positions. It is less obvious that member 28 is also not necessary (although helpful) in the steamer position of FIG. 6*b*. The weight of the futon mattress can keep the multi-angle hook 20 in place in the steamer position. Accordingly, the inclusion of member 28 is considered desirable, but not necessary.

As described the present invention is directed to a multi-angle hook and a method of temporarily securing two frame components of a futon bed together. The multi-angle hook and method of temporarily securing two frame components of a futon bed together of the present invention changes the nature of the attachment two frame components of a futon bed by allowing easy and complete removal of one frame component from another. The multi-angle hook and method of temporarily securing two frame components of a futon bed together of the present invention allow one frame component to be freely lifted off another frame component and alternately lowered and set into place.

The multi-angle hook and method of temporarily securing two frame components of a futon bed together of the present invention facilitates conversion of the futon frame into its various positions (bed, steamer, lounger) because the futon frame is easier to manipulate with one of the frame components removed. Further, defective parts are easily replaced using the multi-angle hook and method of temporarily securing two frame components of a futon bed together of the present invention. Still further, parts management in manufacturing is simpler using the multi-angle hook and method of temporarily securing two frame components of a futon bed together of the present invention, thereby saving production cost.

In a preferred embodiment, the L-shaped hinge 90 is formed as a single piece, preferably of metal, but also possibly of any type of rigid, sturdy, plastic, wood or any other suitable material.

In a preferred embodiment, the at least one hole 91 is counter-sunk. In another preferred embodiment, the number of holes 91 is four, although any number of holes may be used. Further, the manner in which the L-shaped hinge 90 is secured to the back platform 12, such as, screws, bolts, nails, rivets, pins other than clevis pins, staples, snaps, (or any other suitable fastener), glue (which might obviate the need for holes altogether), etc., is not significant, as long as the L-shaped hinge 90 and the back platform 12 are secured together.

It is further noted that, although in the embodiments described above, the seat platform 12 does not include side rails, it may be the back platform 13 or extension 10 (or any combination thereof) which does include side rails.

It is further noted that the hinge need not be L-shaped or even substantially L-shaped, but merely of a shape to substantially conform to the end of the seat platform 12, back platform 13 or extension 10.

As described the present invention is directed an L-shaped hinge and a method of temporarily securing two frame components of a futon bed together.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An L-shaped hinge comprising at least two members, forming an angle with respect to each other, so that said at least two members can contact a side rail-less frame component to provide support to the side rail-less frame component when connected to another frame component, wherein one or both of the frame components is not a billet;

wherein the side rail-less frame component is a futon seat platform and the another frame component is a futon back platform.

2. The L-shaped hinge of claim 1, wherein said at least two members are integral.

3. The L-shaped hinge of claim 1, wherein L-shaped hinge is made of metal, plastic, or wood.

4. The L-shaped hinge of claim 1, wherein two of said at least two members form a substantially right angle.

5. The L-shaped hinge of claim 1, wherein said L-shaped hinge is secured to the futon seat platform by one of at least one nail, bolt, rivet, pin, staple, snap, or glue.

6. The L-shaped hinge of claim 1, wherein the futon seat platform is secured to the futon back platform by a clevis pin.

7. The L-shaped hinge of claim 6, wherein the clevis pin includes two holes, substantially orthogonal to each other.

8. A frame component, comprising:

a side rail-less body; and an L-shaped hinge including at least two members, forming an angle with respect to each other, so that said at least two members can contact the side rail-less body to provide support to the side rail-less body when connected to another frame component wherein one or both of the frame components is not a billet;

wherein the side rail-less frame body is a futon seat platform and the another frame component is a futon back platform.

9. The frame component of claim 8, wherein said at least two members are integral.

10. The frame component of claim 8, wherein said L-shaped hinge is made of metal, plastic, or wood.

11. The frame component of claim 8, wherein two of said at least two members form a substantially right angle.

12. The frame component of claim 8, wherein said L-shaped hinge is secured to the futon seat platform by one of at least one nail, bolt, rivet, pin, staple, snap, or glue.

13. The frame component of claim 8, wherein the futon seat platform is secured to the futon back platform by a clevis pin.

14. The frame component of claim 13, wherein the clevis pin includes two holes, substantially orthogonal to-each other.

15. A futon frame, comprising:

at least two frame components, including at least one side-rail-less frame component and at least another frame component; and an L-shaped hinge including at least two members, forming an angle with respect to each other, so that said at least two members can contact the at least one side-rail-less frame component to provide support to the at least one side-rail-less frame component when connected to the at least another frame component, wherein one or both of the frame components is not a billet;

wherein one of the frame components is a futon seat platform and another frame component is a futon back platform.

16. The futon frame of claim 15, wherein said at least two members are integral.

17. The futon frame of claim 15, wherein said L-shaped hinge is made of metal, plastic, or wood.

18. The futon frame of claim 15, wherein two of said at least two members form a substantially right angle.

19. The futon frame of claim 15, wherein said L-shaped hinge is secured to the futon seat platform by one of at least one nail, bolt, rivet, pin, staple, snap, or glue.

20. The futon frame of claim 15, wherein the futon seat platform is secured to the futon back platform by a clevis pin.

21. The futon frame of claim 20, wherein the clevis pin includes two holes, substantially orthogonal to each other.

22. A method of securing two frame components of a futon bed together, comprising:

providing the two frame components, wherein one of the two frame components is a side rail-less frame component, and an L-shaped hinge including at least two members, forming an angle with respect to each other; and arranging the two frame components and the L-shaped hinge so that said at least two members can contact the at least one side-rail-less frame component to provide support to the at least one side-rail-less frame component when connected to the other frame component wherein one or both of the frame components is not a billet;

wherein one of the frame components is a futon seat platform and another frame component is a futon back platform.

23. The method of claim 22, wherein said at least two members are integral.

24. The method of claim 22, wherein said L-shaped hinge is made of metal, plastic, or wood.

25. The method of claim 22, wherein two of said at least two members form a substantially right angle.

26. The method of claim 22, wherein said L-shaped hinge is secured to the futon seat platform by one of at least one nail, bolt, rivet, pin, staple, snap, or glue.

27. The method of claim 26, wherein the futon seat platform is secured to the futon back platform by a clevis pin.

28. The method of claim 27, wherein the clevis pin includes two holes, substantially orthogonal to each other.

* * * * *